US007479048B1

(12) United States Patent
Kohama et al.

(10) Patent No.: US 7,479,048 B1
(45) Date of Patent: Jan. 20, 2009

(54) COOLING SYSTEM FOR STERN DRIVE

(75) Inventors: Takayoshi Kohama, Amagasaki (JP); Hideo Misao, Amagasaki (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 0 days.

(21) Appl. No.: 11/907,957

(22) Filed: Oct. 18, 2007

(51) Int. Cl.
*B63H 21/14* (2006.01)

(52) U.S. Cl. ..... 440/88 C

(58) Field of Classification Search ..... 440/88 R, 440/88 C, 88 D
See application file for complete search history.

(56) References Cited

U.S. PATENT DOCUMENTS 5,088,946 A 2/1992 Nakayama
5,871,380 A 2/1999 Claussen
6,413,129 B1 7/2002 Okuzawa et al.
6,808,432 B1 10/2004 Davis et al.
7,008,280 B1 3/2006 Taylor et al.

OTHER PUBLICATIONS

European Search Report dated Sep. 9, 2008 in corresponding European patent application No. 08013693.0-1254.

*Primary Examiner*—Jesus D Sotelo
(74) *Attorney, Agent, or Firm*—Posz Law Group, PLC

(57) ABSTRACT

The subject invention provides a cooling system for a stern drive, including: a conduit having a water outlet for discharging ambient water, which is introduced by using a water current generated by propulsion of a boat to which said stern drive is mounted, the water outlet being directed toward a side wall of a housing containing a gear and a clutch where heat is generated, at a location near the gear and the clutch; and a cover removably attachable to the housing, the conduit being contained between the cover and the housing, the cover defining a space to which water is discharged from the water outlet and a drain section for draining the water.

9 Claims, 7 Drawing Sheets

COOLING SYSTEM FOR STERN DRIVE

FIELD OF THE INVENTION

The present invention relates to cooling systems for a stern drive.

BACKGROUND OF THE INVENTION

As is conventionally known, a stern drive (also referred to as an inboard engine—outboard drive) includes an engine provided inboard, and a drive unit provided outboard that transmits power from the engine to a propeller. Further, a cooling system for such a stern drive is also conventionally known. Such a cooling system cools the drive unit by spraying water onto a housing of the drive unit. The water is taken from ambient water of the drive unit, and the water is discharged using water pressure generated by the propulsive speed due to the so-called ram effect.

For example, U.S. Pat. No. 6,808,432, which was issued to Richard A. Davis et al. on Oct. 26, 2004, teaches providing a cover to a housing of a drive unit, and using a cooling unit that discharges water through an outlet on the top of the housing where a gear that generates heat is contained, using ram pressure. However, this cooling system has the following defect. A general housing contains oil to be used as a lubricating oil, or as a hydraulic fluid for operating the hydraulic clutch when a hydraulic clutch is provided. The oil level is enough to soak the gear in the housing, and the space between the oil level and the internal top of the housing has low heat conductivity. In other words, this space serves as a heat insulator. Therefore, the cooling system disclosed in U.S. Pat. No. 6,808,432 does not ensure desirable cooling efficiency.

U.S. Pat. No. 5,871,380, which was issued to Dean Claussen on Feb. 16, 1999, teaches an intercooler for a stern drive using a water jacket, which is provided on the back of the housing, where a gear that generates heat is provided.

However, in this invention, water accumulates in the water jacket, increasing the water pressure inside the water jacket. This inhibits the ram effect. This invention also, therefore, does not ensure desirable cooling efficiency.

SUMMARY OF INVENTION

Therefore, it is the main object of the present invention to provide a cooling system for a stern drive with improved cooling efficiency.

A cooling system for a stern drive, according to a preferred embodiment of the present invention, comprises: a conduit having a water outlet for discharging ambient water, which is introduced by using a water current generated by the propulsion of a boat to which said stern drive is mounted, the water outlet being directed toward a side wall of a housing containing a gear and a clutch where heat is generated, to a location near the gear and the clutch; and a cover removably attachable to the housing, the conduit being contained between the cover and the housing, the cover defining a space to which water is discharged from the water outlet and a drain section for draining the water.

The water outlet may be directed substantially horizontally, in a direction along the side wall of the housing.

The water outlet may be located at a level close to the top of the clutch in the housing.

The cooling system according to the present invention may further comprise a protruding portion for increasing a heat removing effect by the water discharge from the water outlet, the protruding portion being provided at a level lower than the water outlet provided at the location of the side wall of the housing.

The protruding portion may include a rib, which is provided on the side wall of the housing and extends across the side wall.

The protruding portion may include a periphery wall section, which serves as a periphery wall of an observation window for visually confirming an oil level inside the housing, the periphery wall section being protruding from the side wall of the housing.

The drain section may include a gap between an edge of the cover and the housing.

A water outlet is preferably provided on each of a right side wall and a left side wall of the housing.

It is preferable that the cooling system according to the present invention further comprise a boss protruding from the side wall to fix the cover to the side wall of the housing with a bolt, and the height of the conduit is no higher than the protruding height of the boss.

BRIEF DESCRIPTION OF THE DRAWINGS

Preferred embodiments of the present invention are described below with reference to drawings.

DETAILED DESCRIPTION OF THE PREFERRED EMBODIMENT

Figure 1:
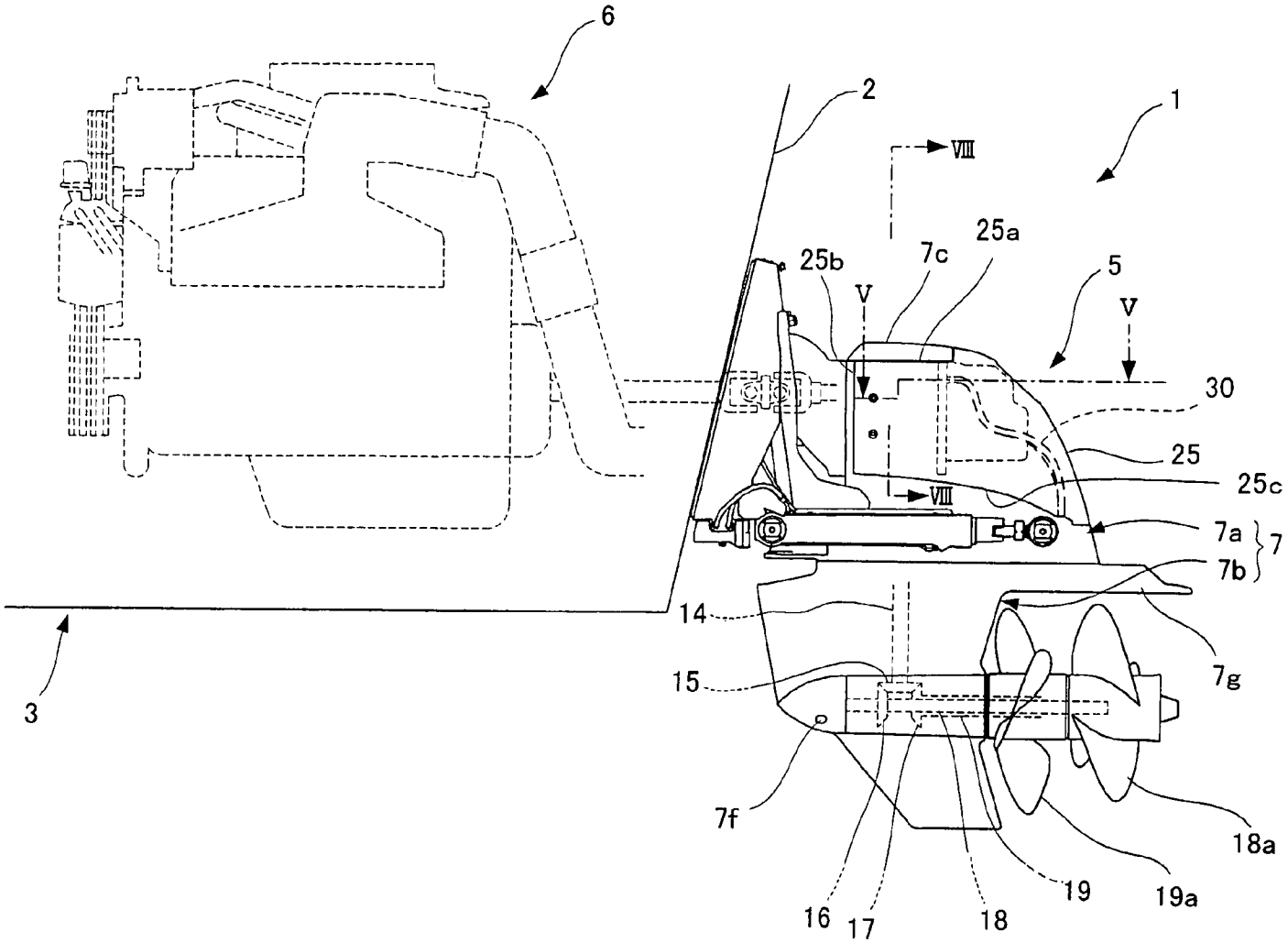
FIG. 1 is a lateral view illustrating a stern drive incorporating a desirable embodiment of the cooling system according to the present invention, and a part of a boat having the stern drive.

A preferred embodiment of a cooling system for a stern drive according to the present invention is described below with reference to drawings.

Throughout the figures, like components will be identified by like reference numerals.

FIG. 1 shows a stern drive 1. The stern drive 1 includes a drive unit 5 which is attached to a transom section 2 and has been arranged outboard of a boat 3, and engine 6 installed inboard of the boat 3.

Figure 2:
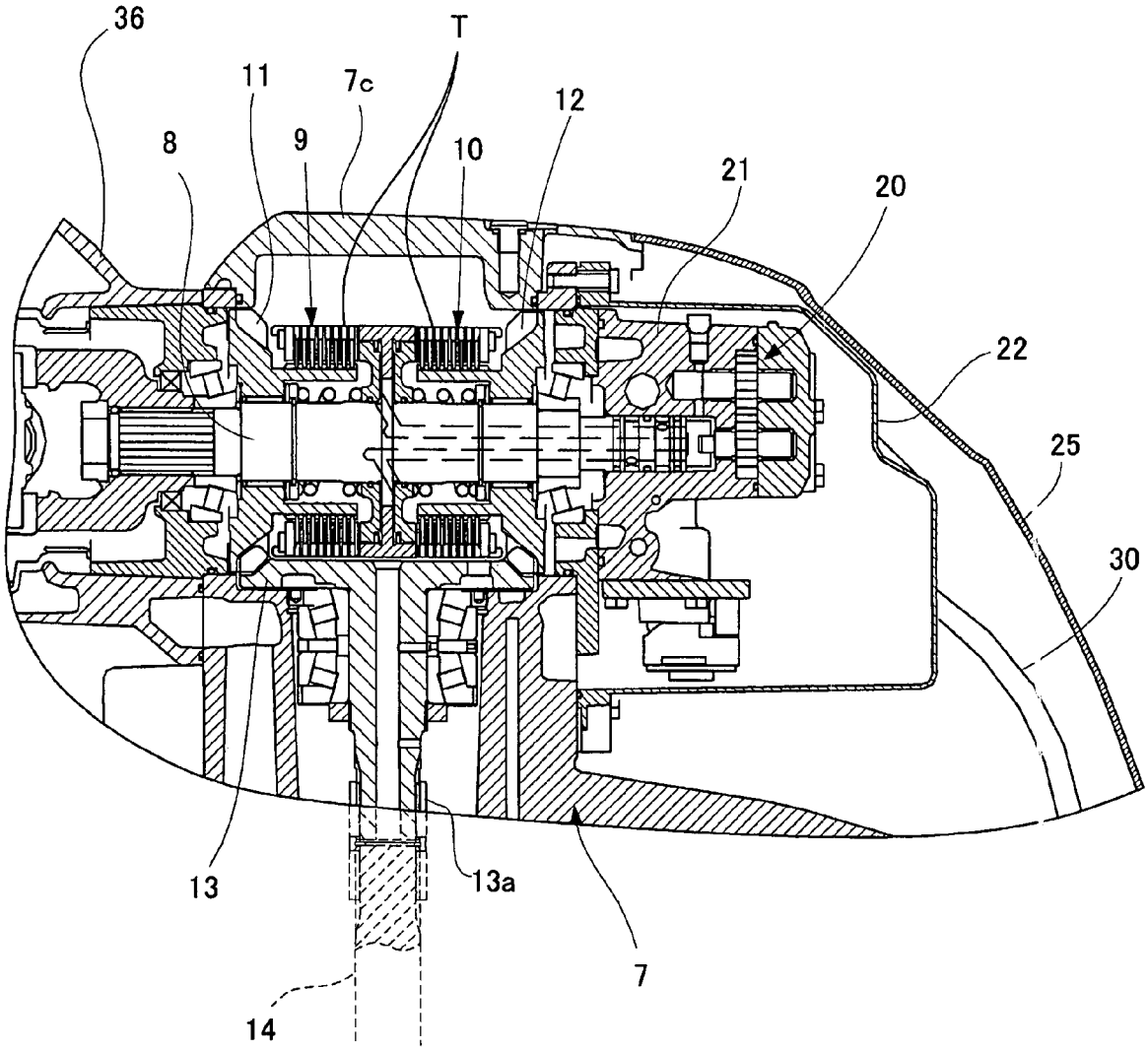
FIG. 2 is a lateral view illustrating an internal structure of a part of the stern drive of FIG. 1.

Referring to FIG. 1 and FIG. 2, a drive unit 5 includes a housing 7; a horizontal shaft 8 connecting to a driveshaft of an engine 6; forward/backward clutches 9 and 10 provided around the horizontal shaft 8; bevel gears 11 and 12 provided in the clutches 9 and 10, respectively; a bevel gear 13 engaged with the bevel gears 11 and 12; a vertical shaft 14 connected with a bevel gear 13 by means of spline engagement via a cylindrical joint 13*a*; a bevel gear 15 fixed to a lower end of the vertical shaft 14; a propeller shaft 18 where a bevel gear 16 engaged with the bevel gear 15 is fixed; and a propeller shaft 19 where a bevel gear 17 engaged with the bevel gear 15 is fixed. The propeller shaft 19 is fitted receivably around the propeller shaft 18, being rotatable relatively to the propeller shaft 18. A propeller 18*a* is fixed to the propeller shaft 18, and a propeller 19*a* is fixed to propeller shaft 19.

Figure 4:
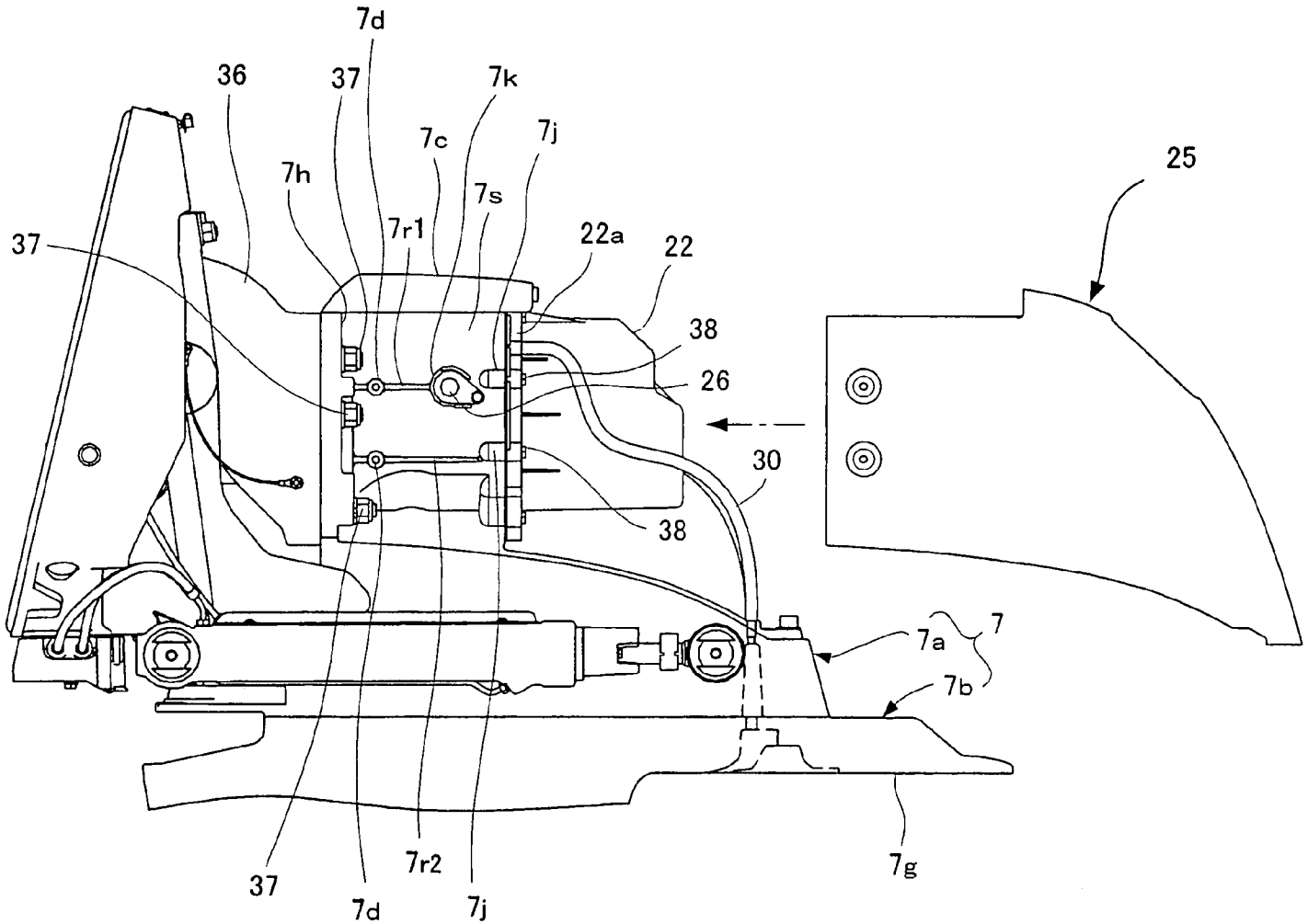
FIG. 4 is a lateral view illustrating a part of an uncovered drive unit of the stern drive of FIG. 1.

Referring to FIG. 1, FIG. 2 and FIG. 4, the housing 7 is provided with an upper gear housing 7*a* and a lower gear housing 7*b*. The upper gear housing contains clutches 9, 10, and upper gears having bevel gears 11, 12, and 13. The lower gear housing contains lower gears having bevel gears 15, 16 and 17.

In FIG. 2, the clutches 9 and 10 are hydraulic multiplate clutches, but they may be realized by other clutches like a cone clutch, an electromagnetic clutch, or a dog clutch. A gear pump 20 is attached to a back end of the horizontal shaft 8. The gear pump 20 pumps up oil (not shown) from the housing 7, and supplies the oil to the upper gear and the clutches 9 and 10 as lubricant oil, and also supplies the oil to the clutches 9 and 10 as hydraulic oil. The gear pump 20 is mounted to an oil block 21, which includes control valves or the like (not shown) for controlling the hydraulic oil of the clutches 9 and 10. The oil block 21 is sealed with a waterproof cover 22 to protect the control valves and other metal components from seawater. The waterproof cover 22 is attached to a back wall of the upper housing 7*a* in a portion close to the upper gear.

Though it is not shown in the figure, the oil level in the housing 7 is generally in the vicinity of the position of the top T of the clutches 9 and 10. When the oil in the housing 7 is reduced, and the oil level decreases, oil is supplied to the housing 7.

Figure 3:
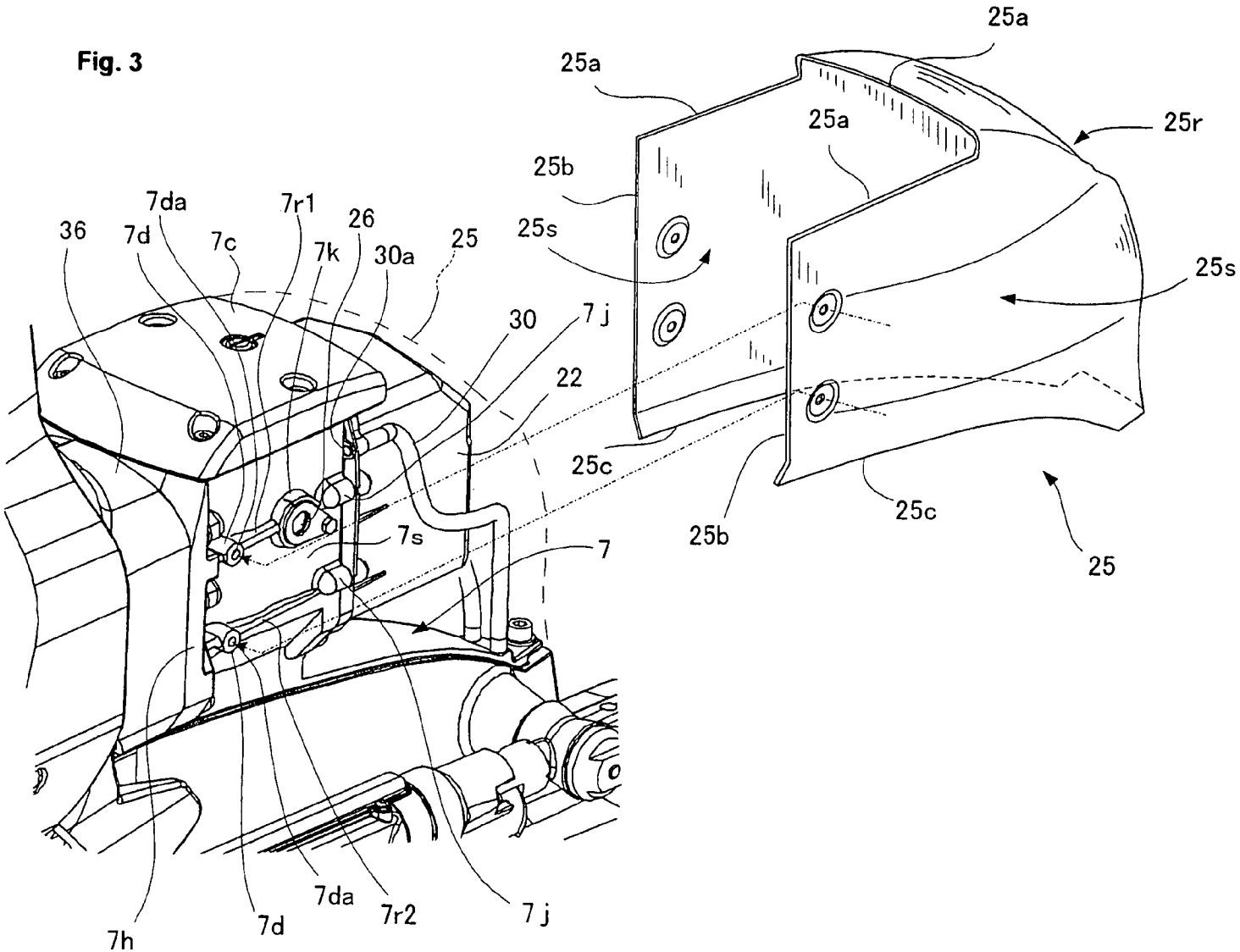
FIG. 3 is a perspective view illustrating a part of the stern drive of FIG. 1 without a cover.

As shown in FIG. 3 and FIG. 4, the drive unit 5 is provided with a removably attachable cover 25 for the housing 7. The cover 25 is constituted of side sections 25*s* and 25*s* and a rear section 25*r*. The top of the cover 25 is open. In attaching the cover 25 to the housing 7, the side sections 25*s* and 25*s* are horizontally spread against the retention elasticity of the cover 25 and the cover 25 slides to the rear side of the housing 7 until they are properly combined. The cover 25 is fixed by a bolt to a threaded hole 7*da* of the boss 7*d*, which is formed as a part of the side wall 7*s* of the housing 7, protruding from the side wall 7*s*.

The cover 25 does not extend over the top panel 7*c* constituting the top face of the housing 7. With this configuration, the width between the two sides of the cover 25 is smaller than that of a cover overlaying on the top of the housing 7 (e.g., the cover disclosed in the U.S. Pat. No. 6,808,432). Therefore, the cover 25 can be formed into a slim shape according to the width of the housing. Further, since the cover 25 does not include a top, the tilt-up angle of the drive unit 5 can be increased.

As shown in FIGS. 3 and 4, by removing the cover 25, the oil level in the housing 7 can be visually confirmed through the oil level observation window 26 formed on the side wall 7*s* of the housing 7. In fabricating the drive unit 5, or during oil changes, oil is supplied through the oil draining/supplying opening 7*f* by means of a pump after the removal of its cap, which is provided in the front bottom of the housing 7 shown in FIG. 1. When the oil level in the housing 7 decreases, oil is supplied from a reservoir tank (not shown) into the housing 7 via a pipe. The reservoir tank is provided in the ship.

Figure 5:
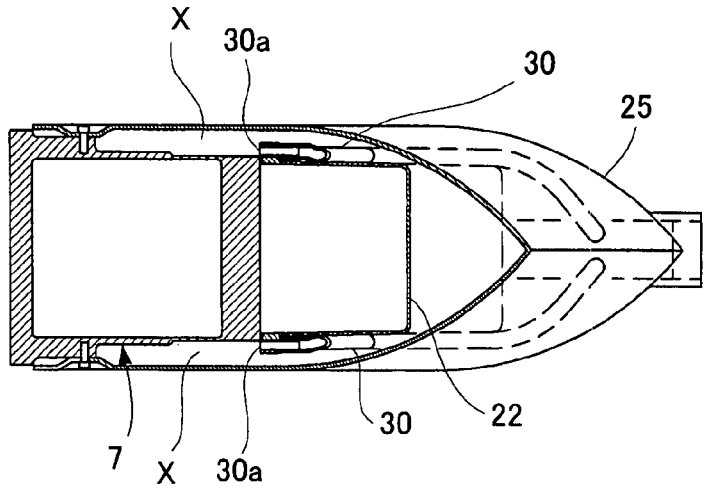
FIG. 5 is a cross-sectional view, taken along the line V-V of FIG. 1.

As shown in FIGS. 3, 4 and 5, the drive unit 5 is provided with two conduits 30 each of which has a water outlet 30*a*. The water outlets 30 are directed respectively to the left and to the right of the side wall 7*s* of the housing 7, to a location near the bevel gears 11, 12 and 13, and the clutches 9 and 10. The water outlet 30*a* can be provided at a height in the vicinity of the top T of the clutches 9 and 10 in the housing 7.

The bevel gears 11, 12 and 13, and the clutches 9 and 10 generate frictional heat. This frictional heat is transferred to the housing 7 through oil, which serves as a heat medium. According to this, the cooling system will serve efficiently by discharging cold water from the water outlet 30*a* to a specific portion of the side wall 7*s*, i.e., the portion near the bevel gears 11, 12 and 13, and the clutches 9 and 10.

As with the illustrated embodiment, a cooling system with such positioning of a water outlet is particularly effective for a drive unit incapable of direct discharge of water to the back wall of the upper housing 7*a* because of the existence of the above-mentioned waterproof cover or the like, or for a drive unit having a gap between the oil level in the housing 7 and the top panel 7*c*, which is the top of the housing 7.

In the illustrated embodiment, the water outlet 30*a* is directed to the front of the side wall 7*s* from the rear. Further, in the illustrated embodiment, the water outlet 30*a* is directed substantially horizontally, in a direction along the side wall 7*s* of the housing 7.

Figure 8:
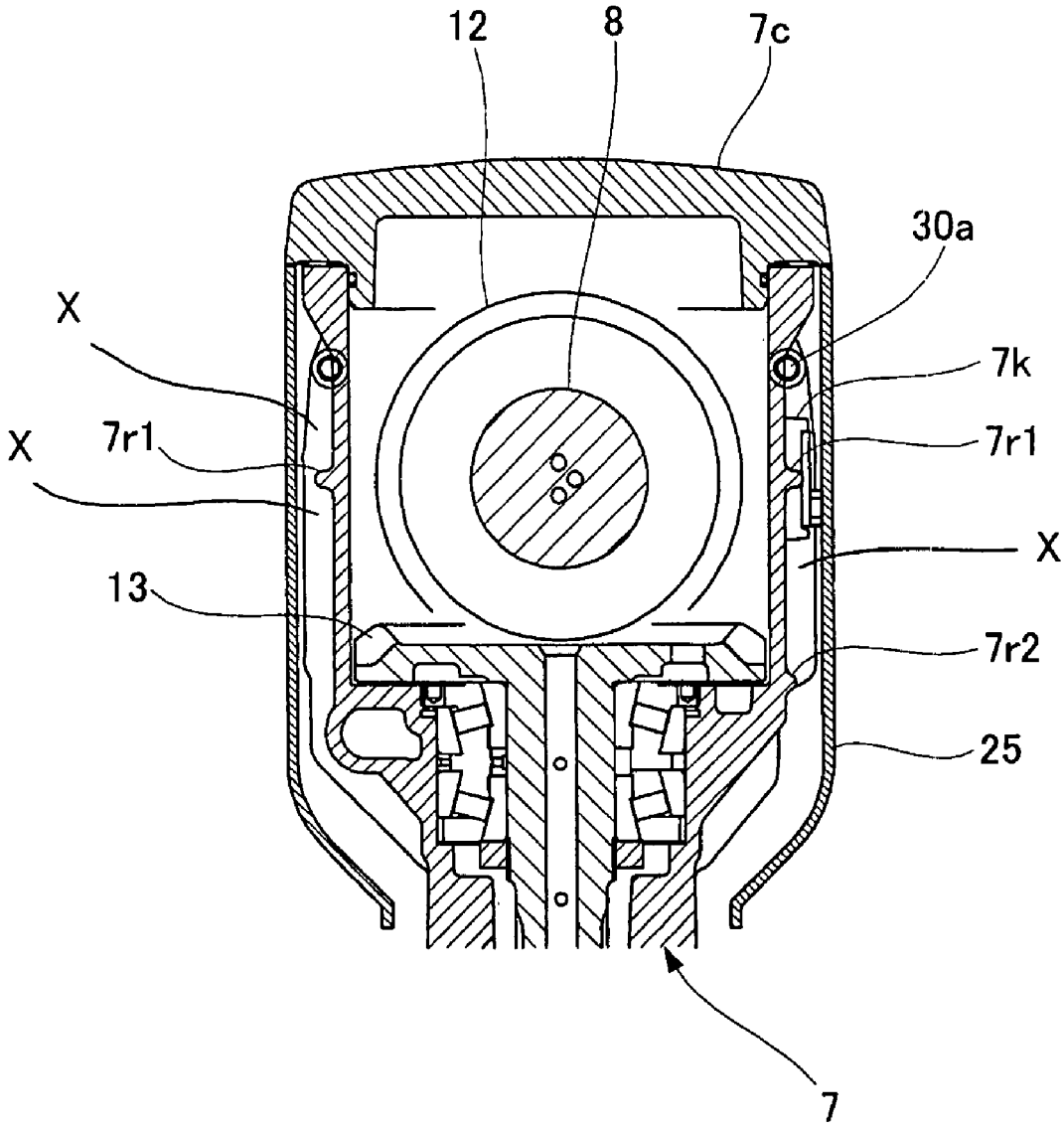
FIG. 8 is a cross-sectional view, taken along the line VIII-VIII of FIG. 1.

As described above, the cover 25 has a slim shape according to the width of the housing 7. Therefore, the conduit 30 has an outer diameter no more than the protruding height of the boss 7*d*. Such a structure improves workability since the cover 25 can be attached or removed to or from the housing 7 without interference from the conduit 30. Further, as shown in FIG. 8, the conduit 30 is arranged so that the inner circumference plane of the water outlet 30*a* comes substantially into contact with a virtual plane extended backward from the side wall 7*s* of the housing 7.

Though this is not shown in the figure, another embodiment may be arranged so that the water outlet is opposed to the side wall 7*s*. A single side wall 7*s* may have a plurality of water outlets. Though the water outlet 30*a* shown in the figure has a circular shape, the water outlet 30*a* may have a rectangular shape, with its long side laid along the side wall 7*s* of the housing 7.

Figure 6:
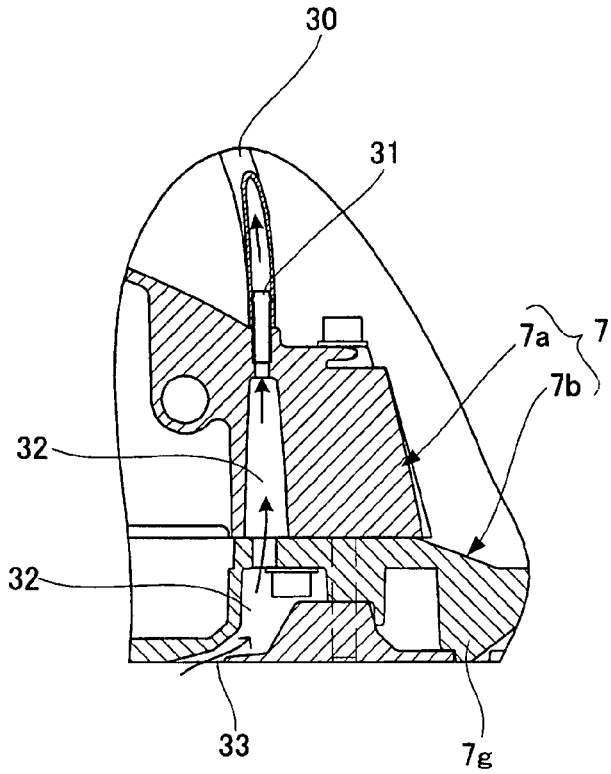
FIG. 6 is a cross-sectional view showing a magnified view of a part of a drive unit of the stern drive of FIG. 1.

As shown in FIG. 6, one end of each conduit 30 is connected to a hose joint 31 that protrudes upward from the rear section of the housing 7. The hose joint 31 is communicated with the hollow section 32 in the housing 7. With reference to FIG. 6 and FIG. 1, the hollow section 32 is opened to the water-introducing inlet 33 provided on the bottom face of an antiventilation plate 7*g*.

When the boat 3 moves forward, as indicated by an arrow in FIG. 6, the water under the antiventilation plate 7*g* enters into a hollow section 32 via the water-introducing inlet 33 due to the dynamic pressure of water flow in the centrifugal direction, which is generated by the propellers 18*a* and 19*a*. The water is then pushed upward through the conduits 30 and 30, and is then discharged strongly from the water outlet 30*a*.

A conduit 30 is contained between the cover 25 and the housing 7, and the cover 25 defines a space X to which water is discharged from the water outlet 30*a*, and a drain section for draining the discharged water. In the illustrated example, the drain section is formed by the gaps between edges 25*b* and 25*c* of the cover 25 and the housing 7. Note that the drain section may be formed by a through hole (not shown) formed on a lower portion of the cover 25. The through hole and the gaps may be provided as the same member. In other possible structures, the gaps are closed, and water is drained via only the through hole. However, it should be noted that the cover 25 can be manufactured more easily in the case of the illustrated example in which only the gaps are formed between the cover 25 and the housing 25, compared with a structure having a through hole on the cover 25.

Referring to FIG. 3 and FIG. 4, the housing 7 has a flange section 7*h* on the front end of the side wall 7*s*. The flange section 7*h* protrudes in the lateral direction. A bell housing 36 is connected to the housing 7 with the bolt 37 via the flange section 7*h*. The gap for draining water is provided between the outer periphery of the flange section 7*h* and the inner periphery of the front edge 25*b* of the cover 25. Since the flange section 7*h* protrudes from the side wall 7*s* of the housing 7, the water discharged from the outlet 30*a*, except for the water drained through the gap between the flange section 7*h* and the front edge 25*b* of the cover 25, collides with the flange section 7*h*, and is brought back to the space X between the side wall 7*s* and the cover 25. As a result, the heat removing effect is improved. The top panel 7*c* of the housing 7 protrudes outward from the side wall 7*s* of the housing 7.

The conduit 30 may be formed by an elastic tube. Referring to FIG. 4, the water outlet 30*a* of the conduit 30 is fixed to the flange section 22*a* of the waterproof cover 22. The flange section 22*a* has a bolt hole (not shown) into which the bolt 38 is inserted to fix the waterproof cover 22 to the housing 7. A boss 7*j* into which the bolt 38 is screwed protrudes from the side wall 7*s* of the housing 7. The boss 7*j* extends horizontally along the side wall 7*s* of the housing 7.

Figure 7:
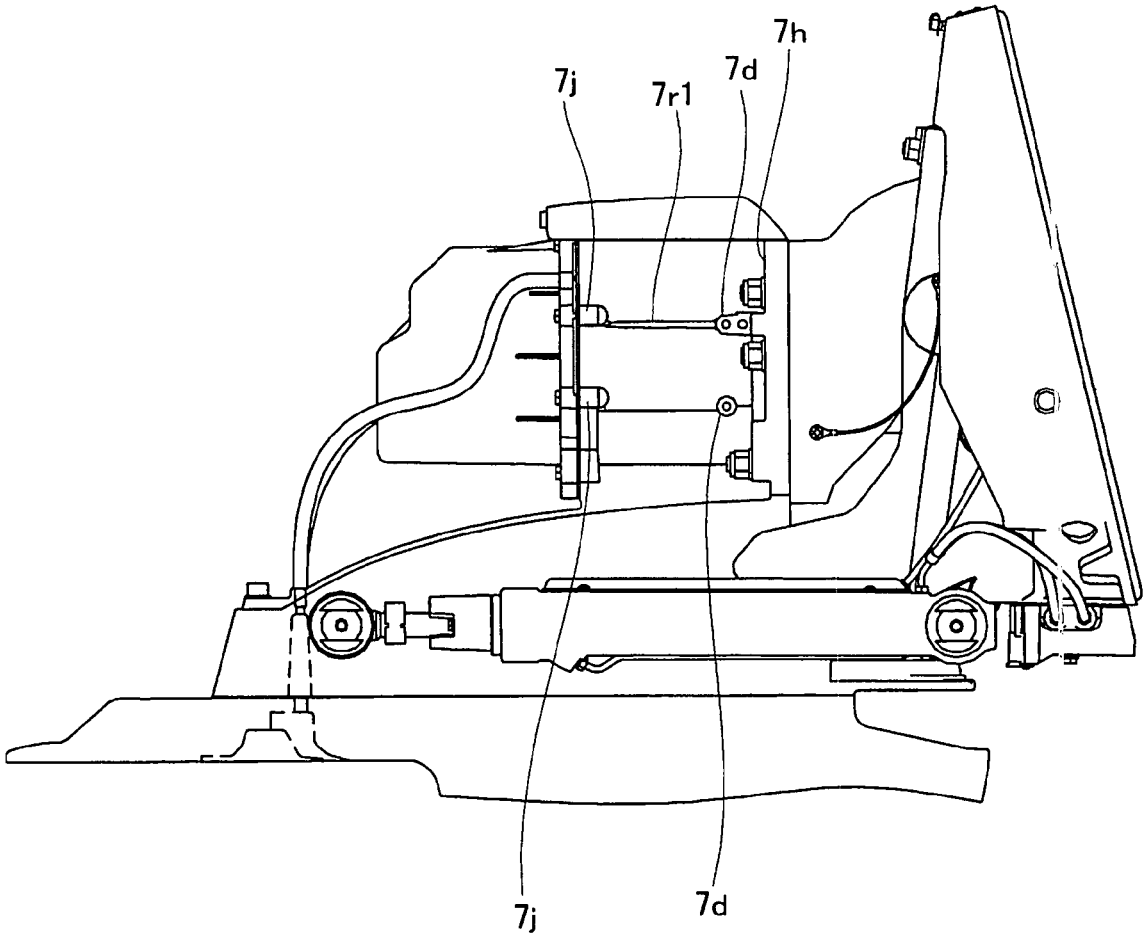
FIG. 7 is a lateral view, opposite to that of FIG. 4.

With reference to FIGS. 3, 4 and 7, ribs 7*r*1 and 7*r*2 are formed on the side wall 7*s* of the housing 7. The ribs 7*r*1 and 7*r*2 extend horizontally along the side wall 7*s*. In the illustrated example, the rib 7*r*1 is formed substantially at the same level as that of the central axis of the horizontal shaft 8. In the illustrated example, the rib 7*r*2 is formed substantially at the same level as that of the engagement position of the bevel gears 11, 12 and the bevel gear 13. In the illustrated example, the rib 7*r*2 is provided on only one of the side walls 7*s* (side wall shown in FIG. 4). The oil level observation window 26 includes a peripheral wall 7*k* that protrudes from the side wall 7*s* of the housing 7. The upper rib 7*r*1 is connected to the peripheral wall 7*k* of the oil level observation window 26 and the boss 7*d*. The lower rib 7*r*2 is connected to the bosses 7*j* and 7*d*. The peripheral wall 7*k* is distant from the boss 7*j* on the oil level observation window 26, but they may be connected by a rib not shown in the figure. The ribs 7*r*1 and 7*r*2 are also connected to the flange section 7*h* on the front of the side wall 7*s* of the housing 7 via bosses 7*d* and 7*d*, respectively. As shown in FIG. 8, gaps for directing water through are formed between the ribs 7*r*1/7*r*2 and the inner wall of the cover 25, and between the peripheral wall 7*k* of the oil level observation window 26 and the inner wall of the cover. Though it is not shown in the figure, the gap for directing water through is also formed between the boss 7*j* and the inner wall of the cover 25. Each side wall 7*s* of the housing 7 may have three or more ribs aligned in the horizontal direction.

The following protruding portions formed on the side wall 7*s* of the housing 7 serve to increase the strength of the housing 7: the ribs 7*r*1 and 7*r*2, the peripheral wall 7*k*, and the bosses 7*d* and 7*j* of the oil level observation window 26. Further, being provided lower than the water outlet 30*a*, they also serve to increase the surface area of the side wall 7*s* of the housing 7. This increases the heat removing effect through the water discharge. Furthermore, depending on the flow rate of the water discharged from the water outlet 30*a*, the heat removing effect due to the water discharge from the housing 7 may further be increased by limiting the natural fall of water discharged from the water outlet 30*a*, or by decreasing the falling speed of the water to increase the contact time of water and the housing 7. This improves the heat absorption effect of the water discharged to the space X formed between the side wall 7*s* of the housing 7 and the cover 25. Consequently, the protruding portions serve to ensure a high heat removing effect even when the propulsion speed of the ship is low and the amount of water discharged from the water outlet 30*a* is small.

The drawings show one embodiment of the present invention, but it should be understood that the scope of the present invention includes some modifications of the embodiment.

The invention claimed is:

1. A cooling system for a stern drive, comprising:

a conduit having a water outlet for discharging ambient water, which is introduced by using a water current generated by propulsion of a boat to which said stern drive is mounted, the water outlet being directed toward a side wall of a housing containing a gear and a clutch where heat is generated, to a location near the gear and the clutch;

a cover removably attachable to the housing, the conduit being contained between the cover and the housing, the cover defining a space to which water is discharged from the water outlet and a drain section for draining the water, wherein the water outlet is directed substantially horizontally in a direction along the side wall of the housing.

2. A cooling system according to claim 1, wherein the water outlet is located at a level close to the top of the clutch in the housing.

3. A cooling system according to claim 1, further comprising a protruding portion for increasing a heat removing effect of the water discharge from the water outlet, the protruding portion being provided at a level lower than the water outlet provided at the location of the side wall of the housing.

4. A cooling system according to claim 3, wherein the protruding portion includes a rib, which is provided on the side wall of the housing and extends across the side wall.

5. A cooling system according to claim 3, wherein the protruding portion includes a periphery wall section, which serves as a periphery wall of an observation window for visually confirming an oil level inside the housing, the periphery wall section being protruding from the side wall of the housing.

6. A cooling system according to claim 1, wherein the drain section includes a gap between an edge of the cover and the housing.

7. A cooling system according to claim 1, wherein the water outlet is provided on each of a right side wall and a left side wall of the housing.

8. A cooling system according to claim 1, further comprising a boss protruding from the side wall to fix the cover into the side wall of the housing with a bolt, a height of the conduit being no higher than the protruding height of the boss.

9. A cooling system according to claim 1, wherein the cover is constituted to cover the rear wall and two side walls of the housing, and the top of the cover is open.

* * * * *